US005699592A

United States Patent [19]

Shimono

[11] Patent Number: 5,699,592

[45] Date of Patent: Dec. 23, 1997

[54] CONCEALED WOVEN SLIDE FASTENER

[75] Inventor: Muchiji Shimono, Toyama-ken, Japan

[73] Assignee: YKK Corporation, Tokyo, Japan

[21] Appl. No.: 807,597

[22] Filed: Feb. 27, 1997

[30] Foreign Application Priority Data

Feb. 29, 1996 [JP] Japan ..... 8-043406

[51] Int. Cl.[6] ..... A44B 19/00

[52] U.S. Cl. ..... 24/432; 24/381; 24/393

[58] Field of Search ..... 24/381, 393, 432, 24/434

[56] References Cited

U.S. PATENT DOCUMENTS

| | | | |
|---|---|---|---|
| 3,768,125 | 10/1973 | Frohlich | 24/432 |
| 3,855,672 | 12/1974 | Takamatsu . | |
| 3,961,652 | 6/1976 | Hasuda et al. | 24/393 |
| 4,143,680 | 3/1979 | Murai et al. . | |
| 4,915,140 | 4/1990 | Ofusa et al. | 24/393 |
| 5,140,725 | 8/1992 | Matsushima | 24/393 |

FOREIGN PATENT DOCUMENTS 0 672 367 9/1995 European Pat. Off. .

*Primary Examiner*—Victor N. Sakran

*Attorney, Agent, or Firm*—Hill, Steadman & Simpson

[57] ABSTRACT

In a concealed woven slide fastener stringer, a fastener tape is woven of foundation warp yarns and a double-pick foundation weft yarn, and a coiled fastener element is attached to folded inner margin of the tape by anchoring warp yarns and a double-pick anchoring weft yarn with coupling heads facing inwardly and connecting portions facing outwardly. The foundation weft yarn is interlaced with the outer one of two core cords inserted through the fastener element. The anchoring warp yarns cross the foundation weft yarn between the successive legs; one of the anchoring warp yarns is disposed between the coupling heads and the inner core cord, and two of the anchoring warp yarns are disposed between the core cords. The anchoring weft yarn is interlaced at one end with the outer anchoring warp yarn and at the other end with the foundation weft yarn crossing the inner anchoring warp yarn, thereby fixing the fastener element firmly.

5 Claims, 5 Drawing Sheets

CONCEALED WOVEN SLIDE FASTENER

BACKGROUND OF THE INVENTION

1. Field of the Invention

This invention relates to a concealed woven slide fastener in which coiled fastener element with core cords inserted therein is woven into a fastener tape along its folded inner margin by a needle weaving machine.

2. Description of the Related Art

FIG. 8 of the accompanying drawings shows a conventional concealed woven slide fastener stringer 3' in which a coiled fastener element 1', with a number of core cords 10' inserted therein is woven into a fastener tape 2' simultaneously with the weaving of the fastener tape 2', upper and lower legs 6', 6' being covered by a tubular weave structure and being tightened by tightening yarns 11' arranged at part of the tubular weave, thus fixing the coiled fastener element 1' to the fastener tape 2'. This prior art is exemplified by Japanese Utility Model Publication No. Sho 50-31131.

FIG. 9 shows another conventional concealed woven slide fastener stringer 2" in which a coiled fastener element 1", with legs 6" compressed flatly on the fastener tape surface and tightened by a number of tightening warp yarns 11" extending over the upper legs 6", is woven into a fastener tape 2" by double-pick weaving using a needle weaving machine. This prior art is disclosed in Japanese Patent Publication No. Sho 46-7018.

In the concealed woven slide fastener stringer 3' of the first-named prior art publication, partly since an increased number of parallel wrap yarns 11' crossing the legs 6' are required in order to hold the fastener element 1' in position on the turnover portion 7' of the folded tape margin of the fastener tape 2' against possible transverse pulling forces, and partly since an increased number of core cords 10' also have to be inserted through the coiled fastener element 1', it is inevitable that the fastener element 1' would become rigid so that an adequately flexible slide fastener cannot be obtained.

In the concealed woven slide fastener stringer 3" of the second-named prior art publication, since no core cord is inserted through the coiled fastener element 1", it is impossible to define the distances between the upper and lower legs 6", 6" uniformly and hence impossible to achieve a stable coupling-head pitch. Further, since the double-pick weft yarn 9" crosses the tightening warp yarns 11" extending over the upper and lower legs 6", 6" and simply turns at the turnover portion of the folded tape margin, the woven structure of the tape would be slack about the turnover portion due to the transverse pulling force so that the inner tape edge would be shift inwardly. As a result, the concealing function of the fastener element 1" is difficult to achieve.

SUMMARY OF INVENTION

A first object of this invention is to provide a concealed woven slide fastener stringer in which the distances between successive legs of a coiled fastener element are defined uniformly to achieve a stable coupling-head pitch and which has an adequate degree of flexibility and is stable in woven structure at a turnover portion of the fastener tape to resist against possible transverse pulling forces, thus concealing the fastener element effectively.

A second object of the invention is to provide a concealed woven slide fastener stringer in which coiled fastener element and core cores are held together by arranging a number of anchoring warp warns in a specified manner, thus concealing the fastener element ore reliably.

A third object of the invention is to provide a concealed woven slide fastener stringer in which a coiled fastener element and core cords are held together by arranging a double-pick weft yarn in a specified pattern, thereby concealing the fastener element more reliably.

A fourth object of the invention is to provide a concealed woven slide fastener stringer in which a foundation weft yarn of a woven fastener tape is interlaced with core cords which are inserted through a coiled fastener element, to reinforce a fastener-element-mounting margin of the fastener tape, thereby facilitating concealing the fastener element.

According to a first aspect of the invention, the first object is accomplished by a concealed woven slide fastener stringer comprising: a fastener tape woven of a plurality of foundation warp yarns and a double-pick foundation weft yarn; a coiled fastener element attached to a folded inner margin of said fastener tape by a number of anchoring warp yarns and a double-pick anchoring weft yarn which are woven in said fastener tape simultaneously with weaving of the fastener tape, and having a succession of coupling heads facing inwardly, a succession of connecting portions, and a succession of upper and lower legs; a plurality of core cords inserted through the coiled fastener element at a side toward the connecting portions and sandwiched between the upper and lower legs; and the anchoring warp yarns extending over said upper legs and being interlaced with said foundation weft yarn, said anchoring weft yarn being interlaced with some of said anchoring warp yarns which extend between said core cords, and extending over one of said core cords which is disposed on a side toward said coupling heads, and crossing said foundation warp yarns at a turnover portion of the folded inner margin of the fastener tape.

The second object is accomplished by a concealed woven slide fastener stringer, in which some of said anchoring warp yarns are arranged between said one core cord and said coupling heads and between said core cords, extend over said upper legs of the fastener element and cross said foundation weft yarn and said anchoring weft yarn, thereby fixing said fastener element firmly.

The third object is accomplished by a concealed woven slide fastener stringer having the foregoing feature, in which said anchoring weft yarn is interlaced at one end with said anchoring warp and is interlaced at the other end with said foundation weft yarn at said turnover portion of said folded inner margin of said fastener tape.

The third object is accomplished alternatively by a concealed slide fastener stringer having any of the foregoing features, in which said anchoring weft yarn is interlaced at one end with some of said anchoring warp yarns which extend between said core cords, extends over said core cords, crosses at the other end said foundation warp yarns at said turnover portion of said folded inner margin of said fastener tape, and extends along with said foundation weft yarn.

The fourth object is accomplished by a concealed slide fastener having any of the foregoing features, in which said foundation weft yarn is interlaced at one end with said core cords inserted through said fastener element at a side toward said connecting portions.

DETAILED DESCRIPTION OF THE PREFERRED EMBODIMENTS

Preferred embodiments of a concealed woven slide fastener stringer according to this invention will now be described in detail with reference to the accompanying drawings.

Figure 1:
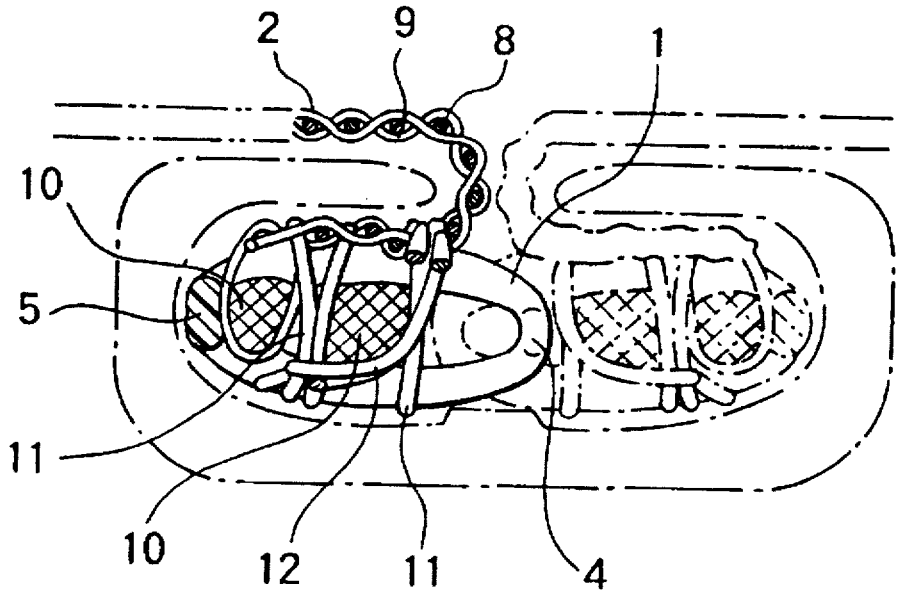
FIG. 1 is a cross-sectional view of a concealed woven slide fastener according to a first embodiment of this invention
Figure 2:
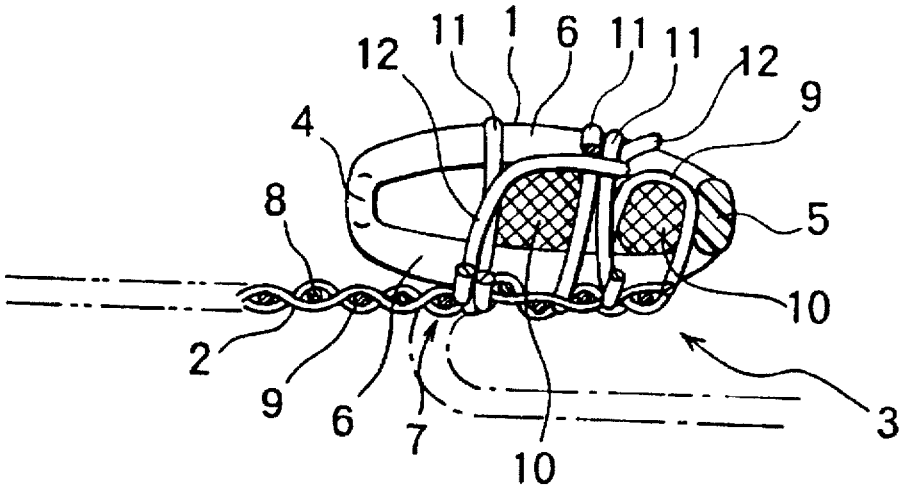
FIG. 2 is a fragmentary cross-sectional view showing one stringer of the concealed woven slide fastener of the first embodiment.

As shown in FIGS. 1 through 4, a concealed woven slide fastener stringer 3 of this invention comprises a woven fastener tape 2, and a coiled fastener element 1 in the form of a monofilament, which is made of thermoplastic synthetic resin such as polyamide and polyester, woven in the fastener tape 2 along its one inner margin. The fastener element 1 has a succession of coupling heads 4, a succession of connecting portions 5, and a succession of sets of upper and lower legs 6. The coiled fastener element 1 is woven into the fastener tape 2 so as that the coupling heads 4 face inwardly of the fastener tape 2, simultaneously with the weaving of the fastener tape 2. The fastener tape 2 is folded at the inner margin to form a turnover portion 7 near and along the coupling heads 4 as shown in FIG. 2, and then is shaped by a heat treatment process, so as to be a fastener stringer 3.

Figure 3:
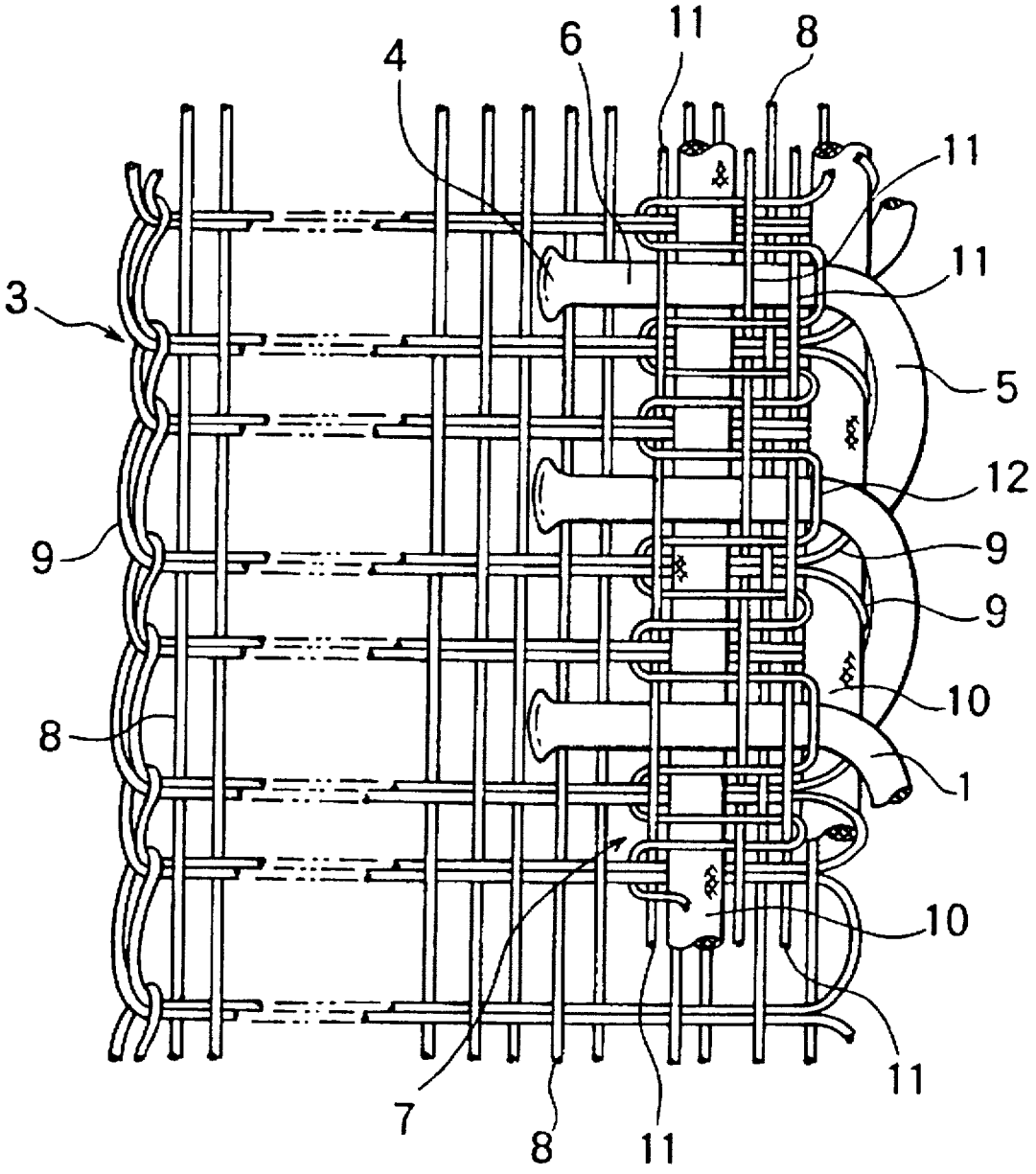
FIG. 3 is a fragmentary view showing a woven structure of the concealed slide fastener stringer of the first embodiment.

The fastener tape 2 is woven of a plurality of foundation warp yarns 8 and a double-pick foundation weft yarn 9 as shown in FIG. 3. The coiled fastener element 1, through which two core cords 10 are inserted along the inner margin of the fastener tape 2, is woven so as that the connecting portions 5 face outwardly of the fastener tape 2. At that time, the foundation weft yarn 9 is interlaced with the core cord 10 disposed on a side toward the connecting portions 5 of the fastener element 1.

Further, a single anchoring warp yarn 11, which is disposed between the coupling heads 4 and the inner core cord 10, and two anchoring warp yarns 11, which are disposed between the inner and outer core cords 10,10, are arranged so as to extend over the upper legs 6 and cross one of two pairs of double-pick foundation weft yarns 9 inlaid twice between the successive legs 6, thereby fixing the fastener element 1 firmly.

Figure 4:
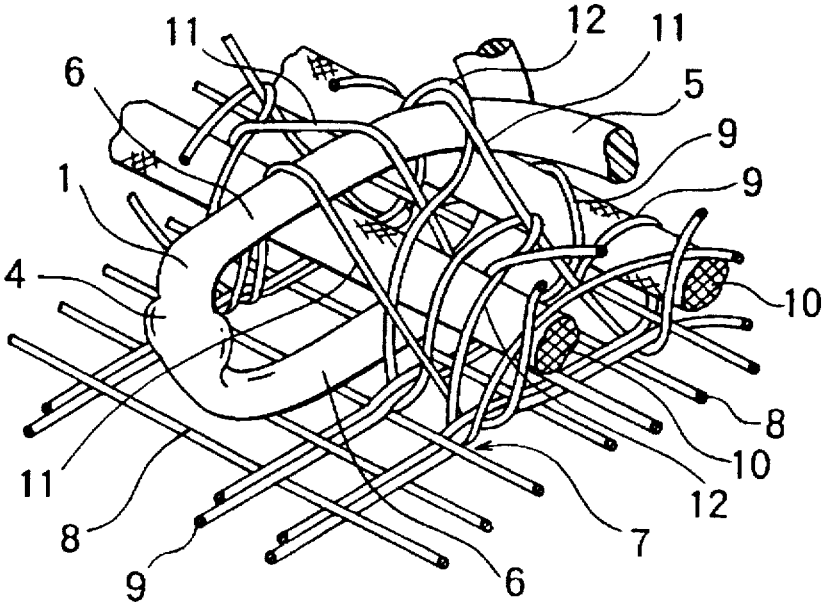
FIG. 4 is a fragmentary perspective view showing the manner in which warp and weft yarns of the concealed woven slide fastener stringer are woven.

On the other hand, the anchoring warp yarns 11 are interlaced with or cross the double-pick weft yarn 12 as shown in FIGS. 3 and 4. For example, the anchoring weft yarn 12 is interlaced at one end with the double-pick foundation weft yarn 9, which is inlaid twice between the successive legs 6 of the fastener element 1, extends an outer surface of the inner core cord 10, and is interlaced at the other end with the anchoring warp yarn 11, which is disposed toward the connecting portions 5 between the inner and outer core cords 10. And the anchoring weft yarn 12 extends over the upper legs 6, is inlaid again and simply crosses the anchoring warp yarn 11 extending adjacent to the anchoring warp yarns 11 on the connecting-portion side. Thus the fastener element 1 is fixed firmly.

In the concealed woven slide fastener stringer 3 of the first embodiment, the number of the core cords 1 inserted through the coiled fastener element 1 is two. Alternatively, the number of core cords 10 may be increased depending on the size and shape of the fastener element 1. The number of anchoring warp yarns 11 also may be increased as desired. Further, it is free to vary the number of the inlaids of the anchoring weft yarns 12 according to the size of the fastener element 1.

The inner core cord 10 which is disposed at a side toward the coupling heads 4 is firmly pressed against the fastener tape 2 by the foundation warp yarns 8 and the double-pick weft yarn 12 interlaced with the anchoring warp yarn 11 disposed between the core cords 10, and at the same tie, the fastener element 1 is pressed against the fastener tape 2. The outer core cord 10 which is disposed at a side toward the connecting portions 5 is interlaced with the double-pick foundation weft yarn 9 and is thereby pressed against the fastener tape 2, and at the same time, the lower legs 6 of the fastener element 1 are pressed against the fastener tape 2. Further, the upper legs 6 are tightened by the anchoring warp and weft yarns 11, 12. As a result, the coiled fastener element 1 is firmly fixed to the inner margin of the fastener tape 2.

Figure 5:
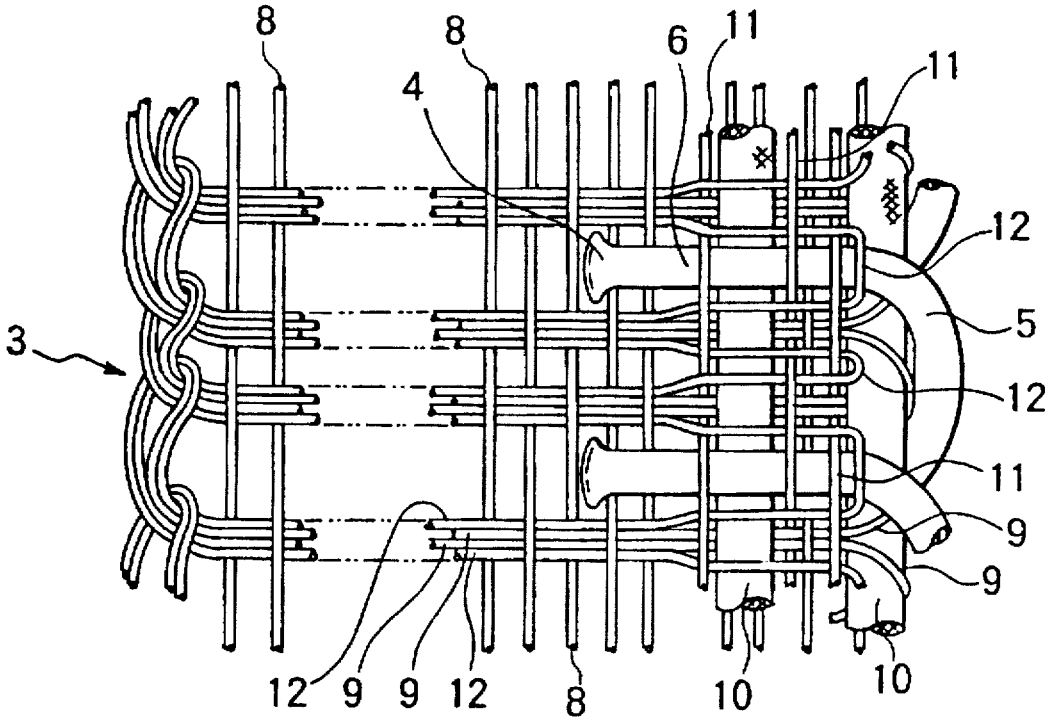
FIG. 5 is a fragmentary view showing a woven structure of the concealed woven slide fastener stringer according to a second embodiment of the invention.
Figure 6:
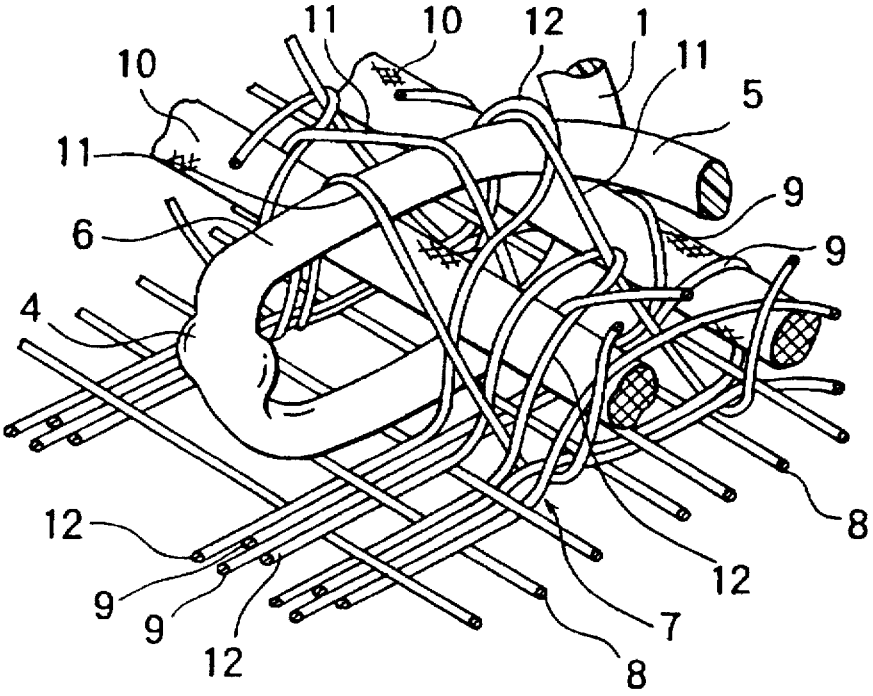
FIG. 6 is a fragmentary perspective view showing the manner in which in which warp and weft yarns of the concealed woven slide fastener stringer of the second embodiment are woven.

FIGS. 5 and 6 show a concealed woven slide fastener stringer according to a second embodiment of this invention. In the second embodiment, the fastener stringer 3 is woven by the same weaving means as in the first embodiment; namely, a fastener tape 2 is woven of foundation warp and weft yarns 8, 9, and a coiled fastener element 1 is woven in and along an folded inner margin of the fastener tape 2. In this embodiment, unlike the first embodiment, anchoring weft yarns 12 are interlaced with an outermost anchoring warp yarn 11 extending over the legs 6, then cross an adjacent anchoring warp yarn 11 which is disposed at a side toward the coupling heads 4, extend over the outer surface of the inner core cord 10 between the inner and outer core cords 10, 10, and then cross an anchoring warp yarn 11 disposed between the coupling heads 4 and the inner core cord 10, whereupon the anchoring weft yarns 12 cross the foundation warp yarn 8 at a turnover portion 7 of the inner margin of the fastener tape 2 and are inlaid in double pick, as a set together with the foundation weft yarns 9, to the edge of the fastener tape 2. The remaining woven structure of this fastener stringer 3 is identical with that of the foregoing embodiment.

Figure 7:
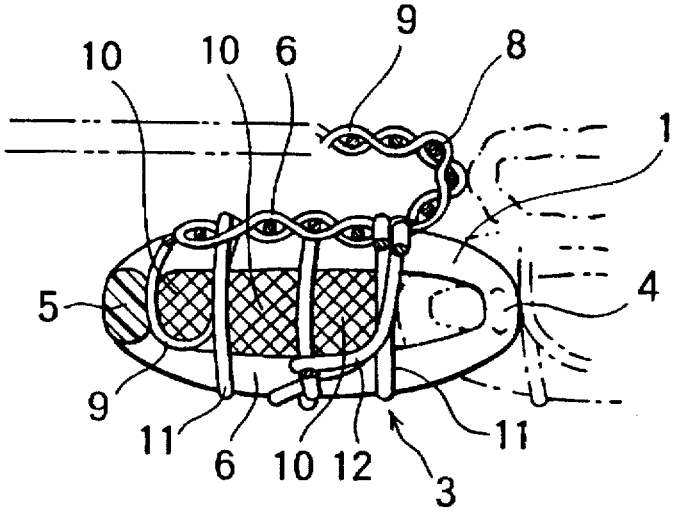
FIG.7 is a fragmentary cross-sectional view showing a concealed woven slide fastener stringer according to a third embodiment of the invention.
Figure 8:
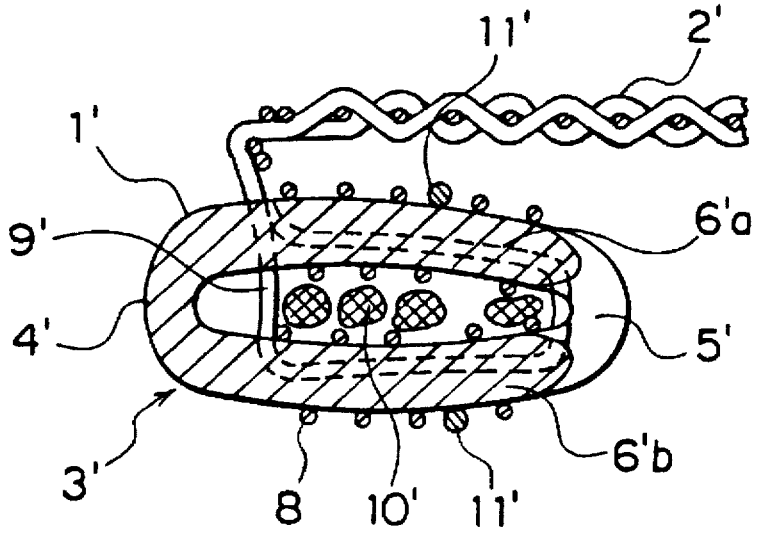
FIG. 8 (PRIOR ART)
FIG. 8 is a fragmentary cross-sectional view showing a conventional concealed woven slide fastener stringer.
Figure 9:
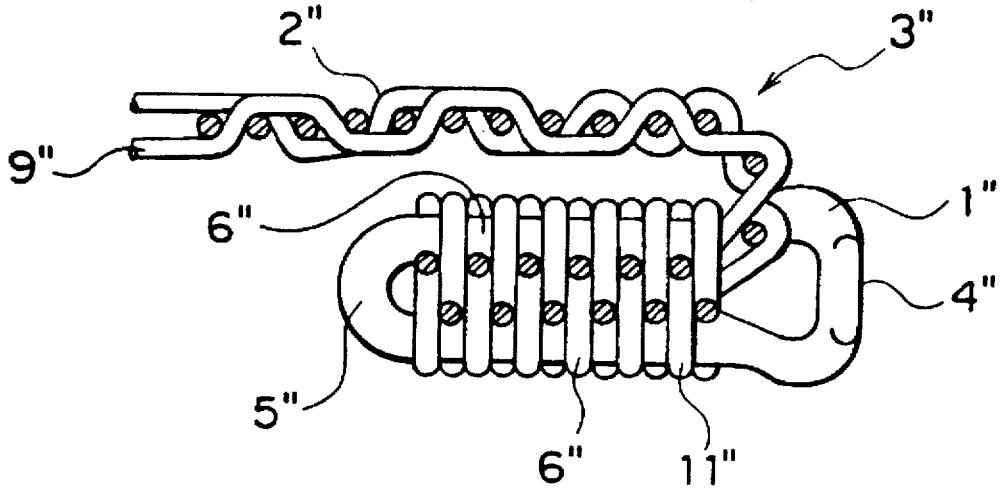
FIG. 9 (PRIOR ART)
FIG. 9 is a fragmentary cross-sectional view showing another conventional concealed woven slide fastener stringer.

FIG. 7 shows a concealed woven slide fastener stringer according to a third embodiment of this invention. In this fastener stringer 3 of this embodiment, a coiled fastener element 1, in which with three core cords 10 inserted is woven in a woven fastener tape 2. Each anchoring warp yarn 11 is disposed between the three core cords 10 respectively. An anchoring weft yarn 12 is interlaced with one of the anchoring warp yarns 11, which is disposed at a side toward the coupling heads 4, and with the other anchoring warp yarn 11, which is disposed between the inner core cord 10 disposed at a side toward the coupling heads 4 and the adjacent intermediate core cord 10, while it extends over the outer surface of the inner core cord 10. As a result, the fastener element 1 is firmly fixed to the fastener tape 2.

With concealed woven slide fastener stringer of this invention, it is possible to obtain the following advantageous results.

According to a first aspect of the invention, the coiled fastener element 1 with a number of core cords inserted at a side toward the connection portions is woven into the fastener tape 2, simultaneously while the fastener tape 2 is woven of foundation warp yarns 8 and a double-pick foundation weft yarn 9. Further, a number of core cords 10 are inserted in the fastener element 1 at a side toward the connecting portions 5. Furthermore, the fastener element 1 is tightened by anchoring warp end weft yarns 11, 12 woven into the fastener tape 2. Accordingly, it requires only a simple weaving means, and it is possible to fix the fastener element 1 firmly.

More specifically, partly since the anchoring warp yarns 11 extend over the upper legs 6 of the fastener element 1 and is interlaced with the foundation weft yarn 9, partly since the core cords 10 are sandwiched between the upper and lower legs 6, 6, and partly since the anchoring weft yarn 12 is interlaced with the anchoring warp yarn 11 disposed between the core cords 10, 10, extends over the outer surface of the inner core cord 10 at a side toward the coupling heads 4 and cross the remaining weaving yarns at the turnover tape portion 7, it is possible to stabilize the fastener element pitch, to tighten the inserted core cords 10 firmly by the anchoring weft yarn 12 to fix the fastener element 1 firmly and reliably by the combination of the anchoring warp and weft yarns 11, 12 and the core cords 10, and to conceal the fastener element 1 reliably. Further, if the turnover portion 7 of the fastener tape 2 is processed by heat treatment, it is possible to maintain a function of concealing the fastener element for a long period of time.

According to a second aspect of the invention, since a number of anchoring warp yarns 11 are disposed between the inner core cord 10 and the coupling heads 4 and between the inner and outer core cords 10, 10, extend over the upper legs 6 and cross the foundation weft yarn 9 and the anchoring weft yarn 11, it is possible to hold the fastener element 1 and the core cords 10 together by the anchoring weft yarn so that the fastener element 1 can fixed firmly, thus causing a reliable concealing function.

According to a third aspect of the invention, since the anchoring weft yarn 12 is interlaced at one end with the anchoring warp yarns 11 which are disposed between the core cords 10, 10, extends over the core cords 10, 10 and is interlaced at the other end with the foundation weft yarn 9 at the turnover portion 7 of the fastener tape 2, it is possible to tighten the core cords 10 firmly on the fastener tape surface by the anchoring weft yarn 12 so that the fastener element 1 and the core cords 10 can be held together reliably, thus concealing the fastener element 1 effectively. Further, since the anchoring weft yarn 12 extends between the anchoring warp yarns 11, 11, it is possible to finish the fastener tape 2 adequately flexible.

According to a fourth aspect of the invention, since the anchoring weft yarn 12 is interlaced at one end with the anchoring warp yarns 11, which are disposed between the core cords 10, extends over the core cords 10, cross the foundation warp yarns 8 at the turnover tape portion 7 and then extend along with the foundation weft yarn 9, it is possible to tighten the core cords 10 firmly on the fastener tape surface by the anchoring weft yarn 12 so that the fastener element 1 and the core cords 10 are held together reliably, thus concealing the fastener element 1 effectively. Further, since anchoring weft yarn 12 is inlaid in the outer anchoring warp yarn 11 and the outer edge of the fastener tape 2 via the outer anchoring warp yarn 11 and the turnover tape portion 7, it is possible to increase the thickness of the fastener tape portion, thus finishing the fastener tape 2 adequately tough.

According to the fifth aspect of the invention, since the foundation weft yarn 9 is interlaced at one end with the outer core cord which is disposed at a side toward the connecting portions 5 of the fastener element 1, it is possible to hold the core cords 10 firmly against the fastener tape surface also by the foundation weft yarn 9, thus facilitating fixing the fastener element 1 firmly.

What is claimed is:

1. A concealed woven slide fastener stringer comprising:

(a) a fastener tape woven of a plurality of foundation warp yarns and a double-pick foundation weft yarn;

(b) a coiled fastener element attached to a folded inner margin of said fastener tape by a number of anchoring warp yarns and a double-pick anchoring weft yarn, which are woven in said fastener tape simultaneously with weaving of the fastener tape 2, and having a succession of coupling heads facing inwardly, a succession of connecting portions facing outwardly, and a succession of upper and lower legs;

(c) a plurality of core cords inserted through said coiled fastener element at a side toward said connecting portions and sandwiched between the succession of upper legs and the succession of lower legs; and (d) said anchoring warp yarns extending over said upper legs (6) and being interlaced with said foundation weft yarn, said anchoring weft yarn being interlaced with some of said anchoring warp outer surface of one of said core cords which is disposed on a side toward said coupling heads, and crossing said foundation warp at a turnover portion of said folded inner margin of said fastener tape.

2. A concealed woven slide fastener stringer according to claim 1, wherein some of said anchoring warp yarns are arranged between said one core cord and said coupling heads and between said core cords, extend over said upper legs of said fastener element and cross said foundation weft yarn and said anchoring weft yarn, thereby fixing said fastener element firmly.

3. A concealed woven slide fastener stringer according to claim 1 or 2, wherein said anchoring weft yarn is interlaced at one end with said anchoring warp yarns inserted between said core cords, extends over said core cords and is interlaced at the other end with said foundation weft yarn at said turnover portion of said folded inner margin of said fastener tape.

4. A concealed woven slide fastener stringer according to claim 1 or 2, wherein said anchoring weft yarn is interlaced at one end with said anchoring warp yarns which extend between said core cords, extends over said core cords, crosses at the other end said foundation warp yarns at said turnover portion of said folded inner margin of said fastener tape, and extends along with said foundation weft yarn.

5. A concealed woven slide fastener stringer according to claim 1 or 2 wherein said foundation weft yarn is interlaced at one end with said core cord inserted through said fastener element at a side toward said connecting portions.

* * * * *